US009089165B2

(12) United States Patent
Bertuzzi et al.

(10) Patent No.: US 9,089,165 B2
(45) Date of Patent: Jul. 28, 2015

(54) PACKAGE OF TOBACCO ARTICLES WITH AN INNER PACKAGE FITTED WITH A SEALING FLAP FIXED TO A HINGED LID

(75) Inventors: Ivanoe Bertuzzi, Casalecchio di Reno (IT); Antonio Vitali, Molinella (IT); Andrea Biondi, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 13/988,597

(22) PCT Filed: Apr. 30, 2012

(86) PCT No.: PCT/IB2012/052160

§ 371 (c)(1),
(2), (4) Date: Jun. 26, 2013

(87) PCT Pub. No.: WO2012/147073

PCT Pub. Date: Nov. 1, 2012

(65) Prior Publication Data

US 2014/0110286 A1 Apr. 24, 2014

(30) Foreign Application Priority Data

Apr. 29, 2011 (IT) ..... BO2011A0234

(51) Int. Cl.

| | |
|---|---|
| ***A24F 15/12*** | (2006.01) |
| ***B65D 75/58*** | (2006.01) |
| ***B65D 85/10*** | (2006.01) |

(52) U.S. Cl.

CPC ..... *A24F 15/12* (2013.01); *B65D 75/5894* (2013.01); *B65D 85/1045* (2013.01)

(58) Field of Classification Search

CPC .. B65D 5/543; B65D 5/6691; B65D 85/1027; B65D 85/1081; B65D 75/5894; B65D 85/1045; A24F 15/12

USPC ..... 206/264, 268, 271, 273; 229/160.1

See application file for complete search history.

(56) References Cited

U.S. PATENT DOCUMENTS

| | | | | |
|---|---|---|---|---|
| 6,736,262 | B2 * | 5/2004 | Focke et al. | 206/268 |
| 8,091,703 | B2 * | 1/2012 | Marchetti et al. | 206/268 |
| 2005/0130822 | A1 | 6/2005 | Rath | |

FOREIGN PATENT DOCUMENTS

| | | | |
|---|---|---|---|
| BE | 365658 | A | 12/1929 |
| WO | WO-00/01594 | A1 | 1/2000 |
| WO | WO-03/070601 | A1 | 8/2003 |
| WO | WO-2008/142540 | A1 | 11/2008 |

OTHER PUBLICATIONS

International Search Report in international application No. PCT/IB2012/052160, dated Oct. 5, 2012.

* cited by examiner

*Primary Examiner* — Bryon Gehman

(74) *Attorney, Agent, or Firm* — Marshall, Gerstein & Borun LLP

(57) ABSTRACT

A package of tobacco articles having a group of tobacco articles; a cup-shaped outer container having an open top end, and a cup-shaped lid hinged to the outer container along a hinge to rotate, with respect to the outer container, between an open position and a closed position opening and closing the open top end respectively; and an inner package, which is housed in the outer container, encloses the group of tobacco articles, and has a tobacco article extraction opening closed by a sealing flap; the sealing flap having a connecting tab glued permanently and non-removably to the lid, so that opening and closing the lid also simultaneously opens and closes the sealing flap.

21 Claims, 11 Drawing Sheets

PACKAGE OF TOBACCO ARTICLES WITH AN INNER PACKAGE FITTED WITH A SEALING FLAP FIXED TO A HINGED LID

CROSS-REFERENCE TO RELATED APPLICATIONS

This is the U.S. national phase of International Application No. PCT/IB2012/052160, filed Apr. 30, 2012, which claims the benefit of Italian patent Application No. BO2011A000234 filed Apr. 29, 2011.

TECHNICAL FIELD

The present invention relates to a package of tobacco articles with an inner package fitted with sealing flap.

In the following description, reference is made, purely by way of a non-limiting example, to a rigid, hinged-lid packet of cigarettes.

BACKGROUND ART

Rigid, hinged-lid packets of cigarettes are currently the most widely marketed, by being easy to produce and easy and practical to use, and by effectively protecting the cigarettes inside.

A rigid, hinged-lid packet of cigarettes comprises an inner package defined by a foil-wrapped group of cigarettes; and a rigid outer package housing the inner package. The outer package comprises a cup-shaped container housing the group of cigarettes and having an open top end, and a cup-shaped lid hinged to the container to rotate, with respect to the container, between an open position and a closed position opening and closing the open end respectively. A U-folded collar is normally connected to the inside of the container, and projects partly outwards of the open end to engage a corresponding inner surface of the lid in the closed position.

In the rigid, hinged-lid packet of cigarettes described in Patent Application EP2155568A1, the inner package is sealed, and comprises a sheet of airtight packing material with a cigarette extraction opening sealed by a re-usable sealing flap. In other words, the sealing flap has fastening means (e.g. a non-dry, re-stick adhesive strip) by which to repeatedly secure the sealing flap in a position closing the cigarette extraction opening. To open and close the packet easily, i.e. to open or close the lid of the outer package and the sealing flap of the inner package together in one operation, a portion of the sealing flap is glued permanently and non-removably to the lid, so that opening or closing the lid also opens or closes the sealing flap simultaneously.

It has been observed, however, that, in rigid, hinged-lid packets of cigarettes as described in Patent Application EP2155568A1, the glue connecting the sealing flap to the lid often fails after a few lid opening and closing cycles, thus resulting in detachment of the sealing flap from the lid.

DESCRIPTION OF THE INVENTION

It is an object of the present invention to provide a package of tobacco articles with an inner package fitted with a sealing flap, designed to eliminate the above drawbacks, and which at the same time is cheap and easy to produce.

According to the present invention, there is provided a package of tobacco articles with an inner package fitted with a sealing flap, as claimed in the accompanying Claims.

BRIEF DESCRIPTION OF THE DRAWINGS

A number of non-limiting embodiments of the present invention will be described by way of example with reference to the attached drawings, in which.

PREFERRED EMBODIMENTS OF THE INVENTION

Figure 2:
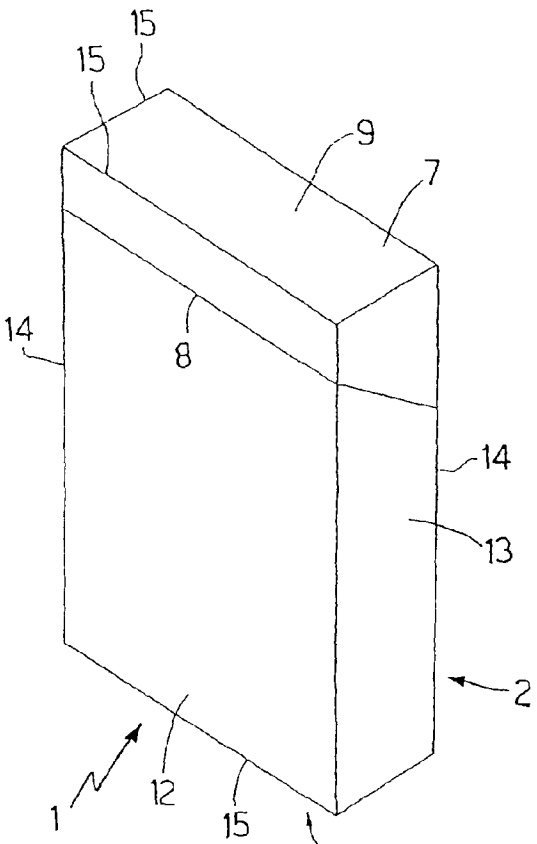
FIGS. 1 and 2 show two views in perspective of a packet of cigarettes, in accordance with the present invention, in a closed configuration.
Figure 1:
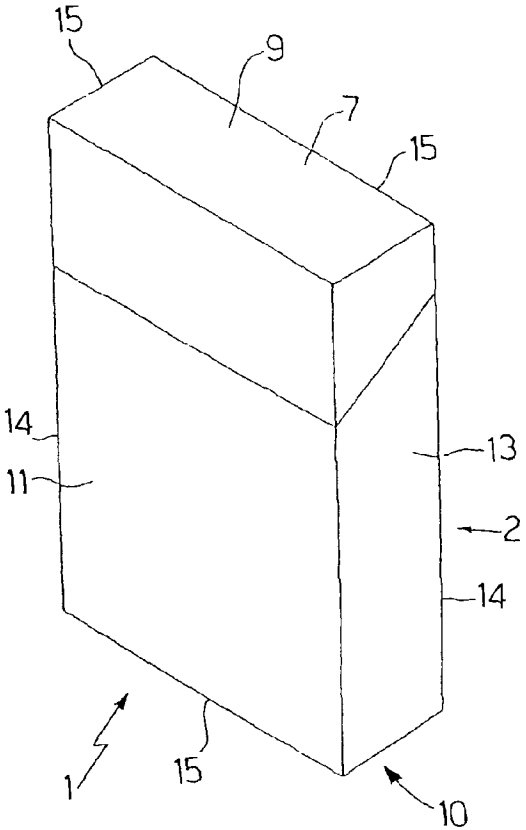
Figure 4:
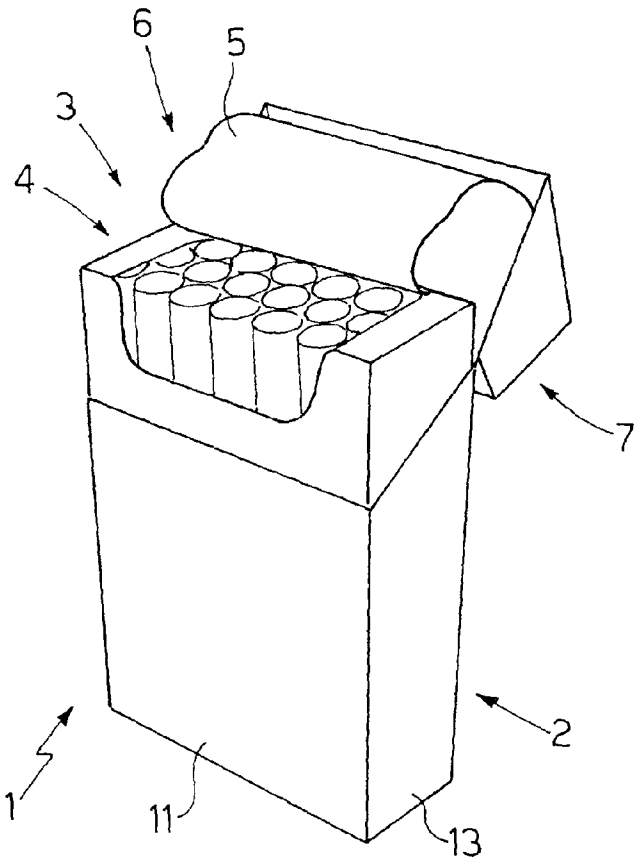
FIG. 4 shows a front view in perspective of the FIG. 1 packet of cigarettes in a fully open configuration.
Figure 3:
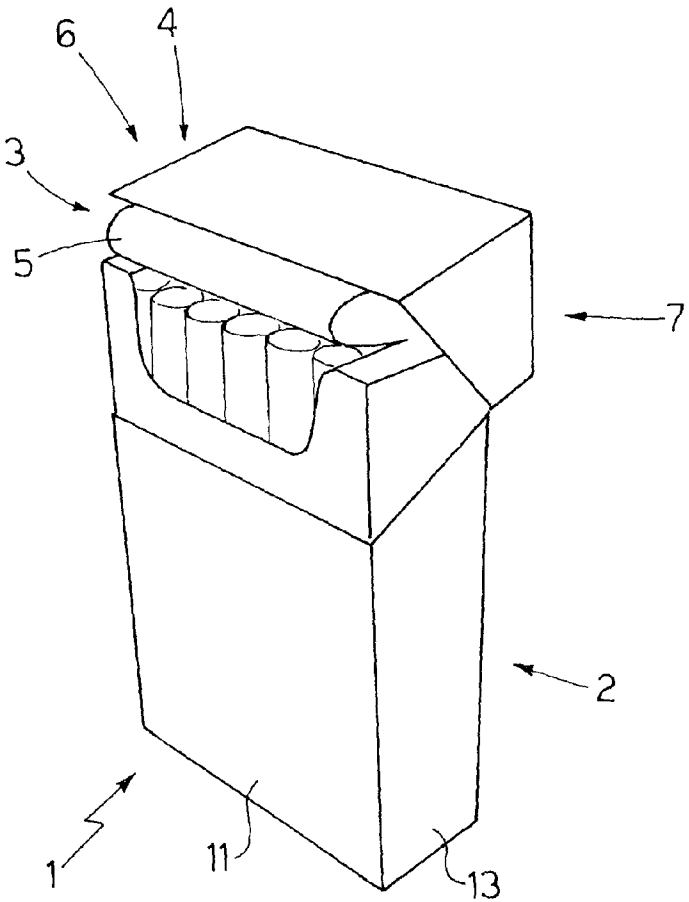
FIG. 3 shows a front view in perspective of the FIG. 1 packet of cigarettes in a partly open configuration.
Figure 5:
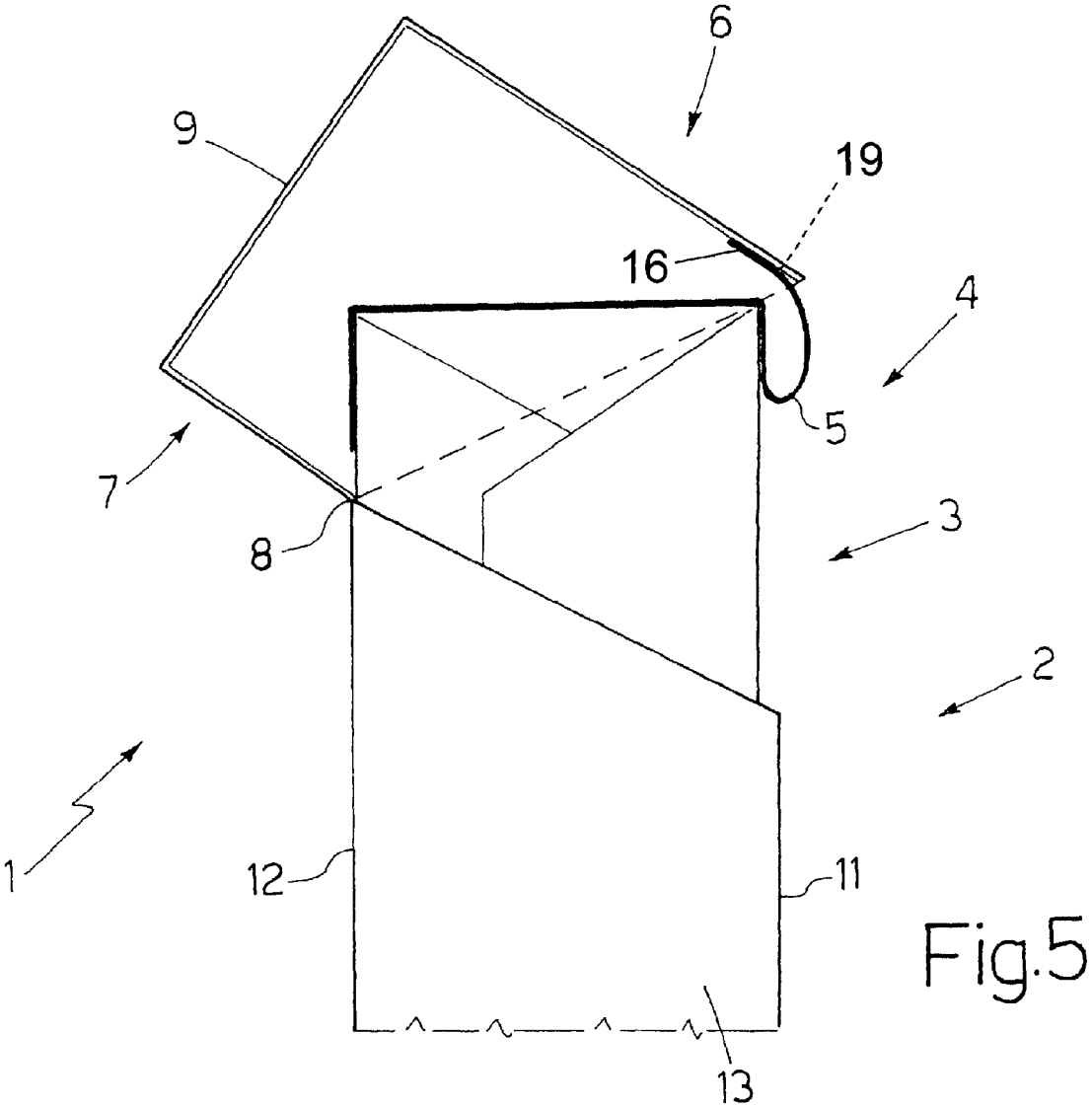
FIG. 5 shows a lateral section of a top portion of the FIG. 1 packet of cigarettes in a partly open configuration.
Figure 6:
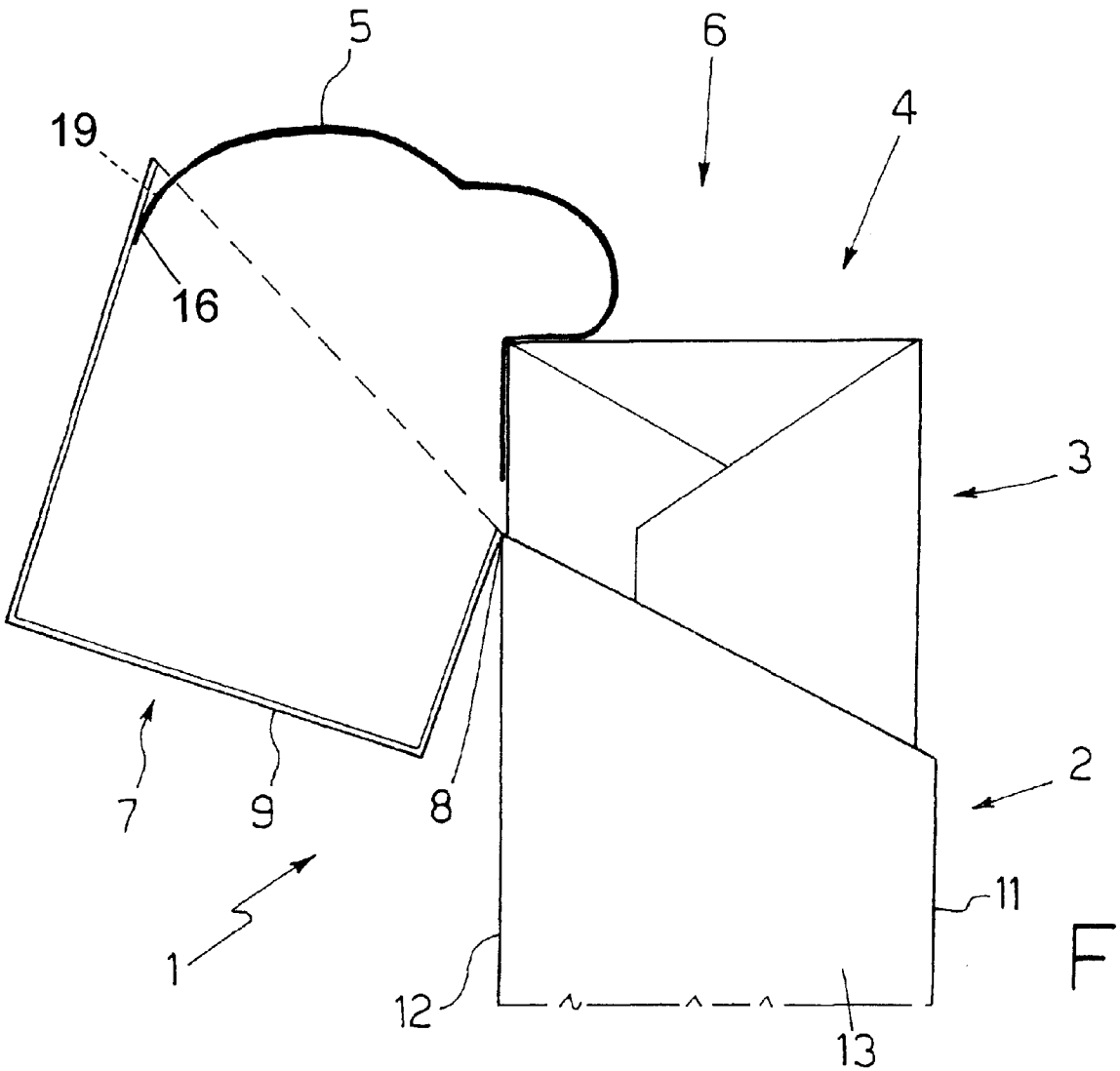
FIG. 6 shows a lateral section of a top portion of the FIG. 1 packet of cigarettes in a fully open configuration.

Number 1 in FIGS. 1-4 indicates as a whole a rigid packet of cigarettes, comprising a cup-shaped, cardboard outer container 2; and an inner package 3 housed inside container 2. Inner package 3 encloses a parallelepiped-shaped group of cigarettes, and has, at the top and front, a cigarette extraction opening 4 closed by a re-usable sealing flap 5.

Outer container 2 has an open top end 6; and a cup-shaped lid 7 hinged to container 2 along a hinge 8 to rotate, with respect to container 2, between an open position (FIGS. 3 and 4) and a closed position (FIGS. 1 and 2) opening and closing open top end 6 respectively.

When lid 7 is closed, outer container 2 is in the form of a rectangular parallelepiped having a top wall 9 and an opposite parallel bottom wall 10; two opposite parallel major lateral walls 11 and 12; and two opposite parallel minor lateral walls 13. More specifically, one major lateral wall 11 defines a front wall 11 of outer container 2, and the other major lateral wall 12 defines a rear wall 12 of outer container 2. Four longitudinal edges 14 are defined between minor lateral walls 13 and front and rear walls 11, 12; and eight transverse edges 15 are defined between top and bottom walls 9, 10 and front and rear walls 11, 12 and minor lateral walls 13. In the embodiments shown in the drawings, edges 14 and 15 are all square. In a different embodiment not shown, the four longitudinal edges 14 are rounded or bevelled.

In the embodiments shown in the drawings, packet 1 of cigarettes has no collar. In a different embodiment not shown, packet 1 of cigarettes comprises a collar, which is folded into a U and fixed (normally glued) to the inside of outer container 2, and projects partly outwards of open top end 6 to engage a corresponding inner surface of lid 7 when lid 7 is closed. The collar preferably has retainers (e.g. two lateral projections) for holding lid 7 in the closed position.

Figure 7:
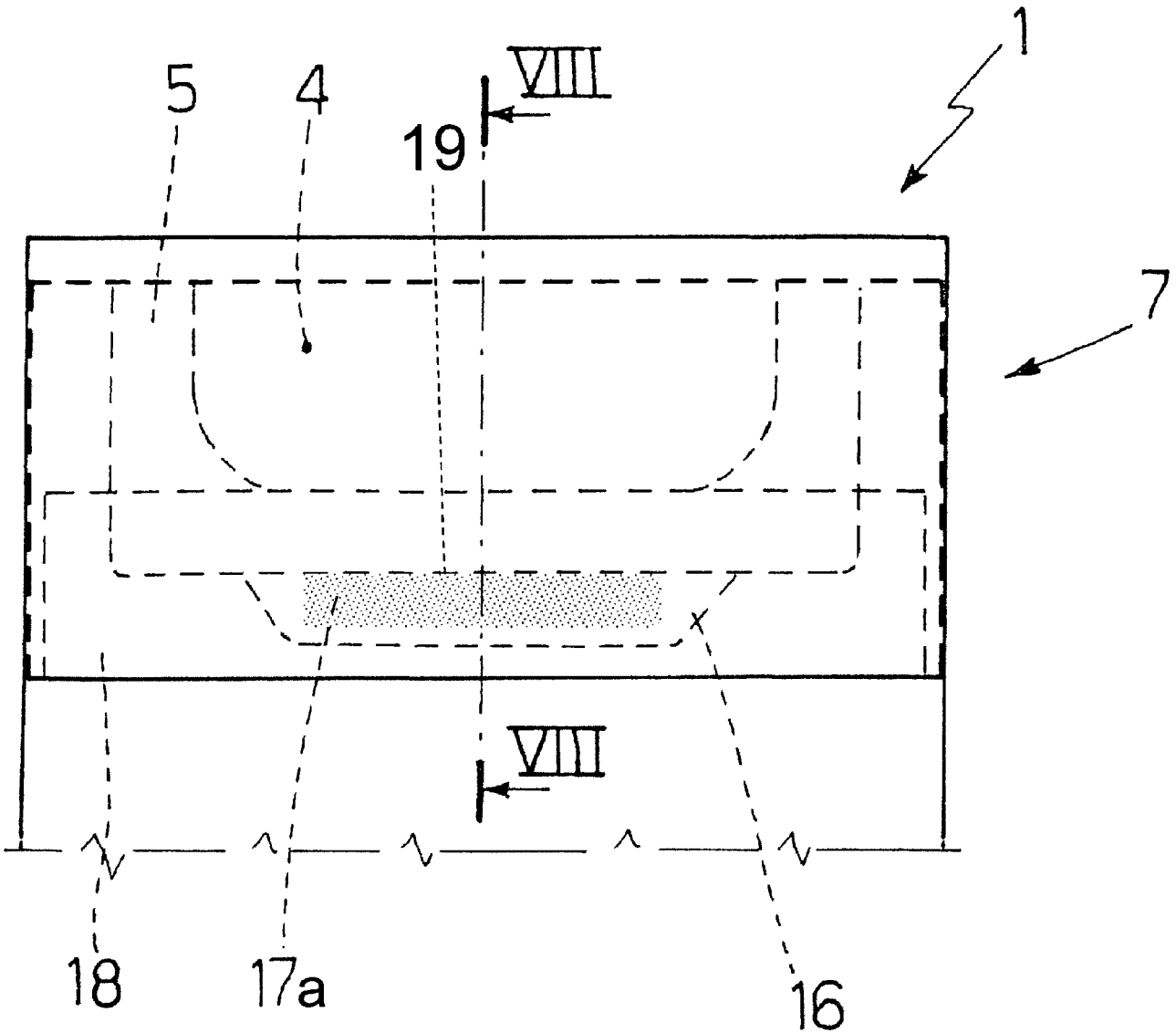
FIG. 7 shows a front view, with parts removed for clarity, of a top portion of the FIG. 1 packet of cigarettes.

Sealing flap 5 is fixed to inner package 3 by non-dry, re-stick glue 17*b* applied to the underside of sealing flap 5, about the whole of extraction opening 4, to allow sealing flap 5 to be detached partly from and re-fixed to inner package 3 (i.e. each time packet 1 of cigarettes is opened). As shown in FIG. 7, sealing flap 5 comprises a connecting tab 16 glued permanently and non-removably to the inner surface of lid 7 by permanent glue 17*a*.

As shown in FIGS. 5-8, connecting tab 16 of sealing flap 5 is glued permanently and non-removably to the inner surface of lid 7, so that opening or closing lid 7 also simultaneously opens or closes sealing flap 5. In a different embodiment not shown, connecting tab 16 is a different shape and/or size from the one shown in the drawings. For example, connecting tab 16 may be same width as the rest of sealing flap 5 (as opposed to narrower, as in the embodiment shown in the drawings).

Figure 8:
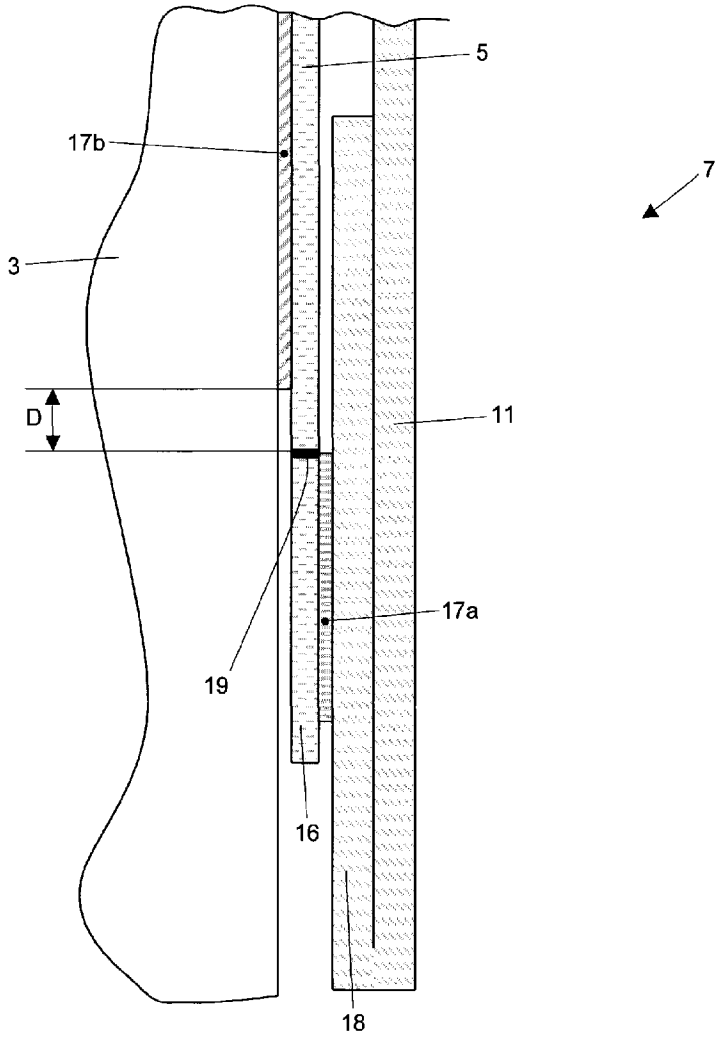
FIG. 8 shows a lateral section along line VIII-VIII of a detail in FIG. 7.

As shown in FIGS. 7 and 8, an outer surface of connecting tab 16 of sealing flap 5 is glued by permanent glue 17*a* (i.e. dried, non-reusable glue) to a flap 18 of lid 7, so that connecting tab 16 of sealing flap 5 remains flat and separate from the rest of sealing flap 5, and sealing flap 5 forms an S-shaped bend when opening lid 7.

Figure 9:
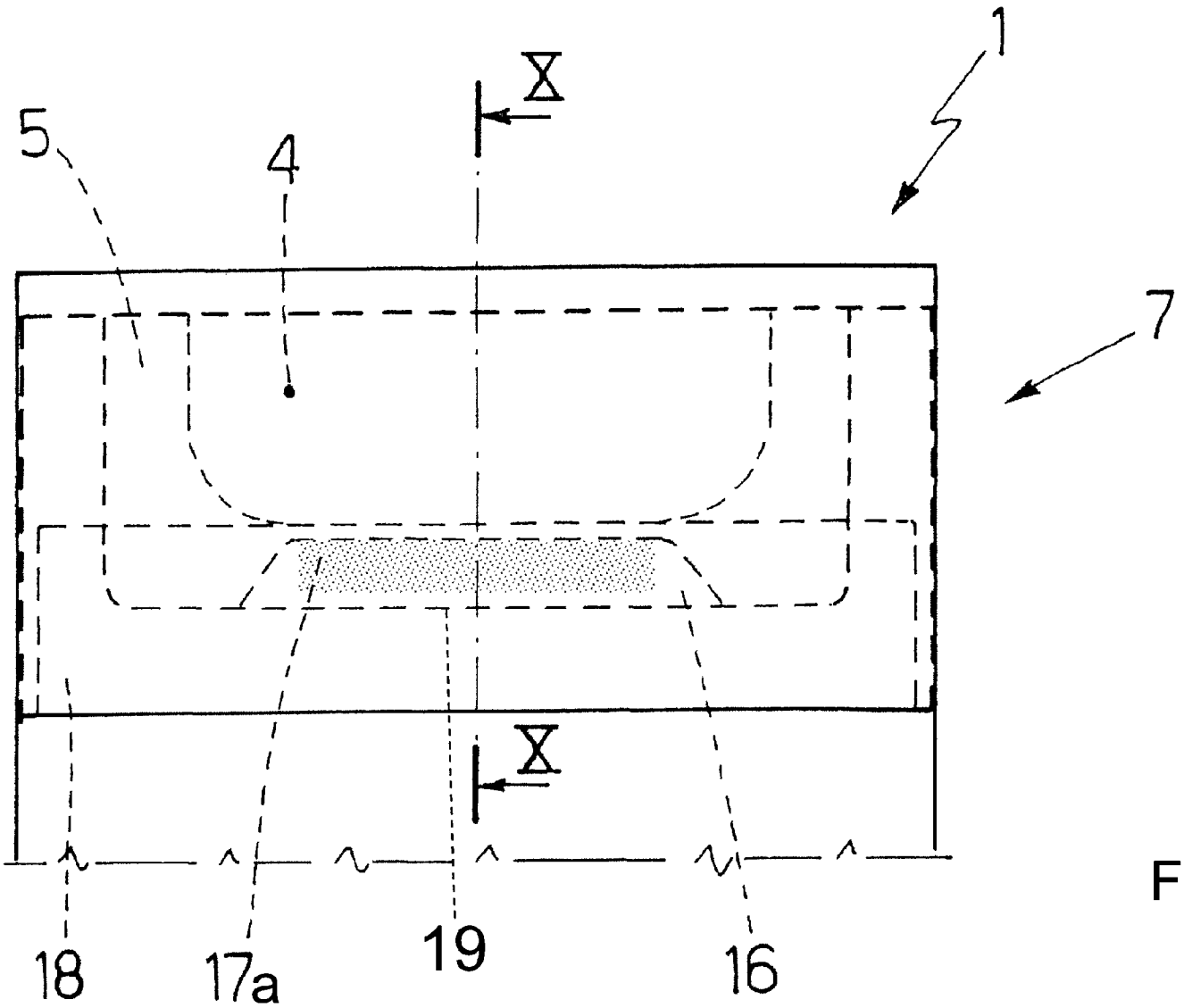
FIG. 9 shows a front view, with parts removed for clarity, of a variation of a top portion of the FIG. 1 packet of cigarettes.
Figure 10:
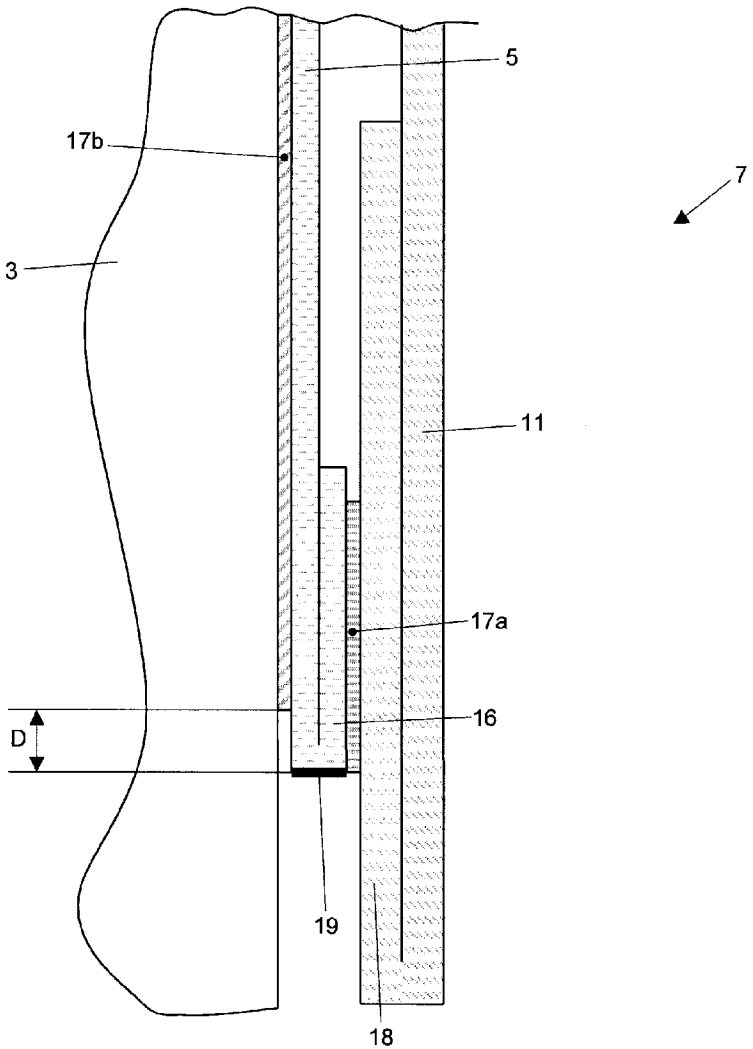
FIG. 10 shows a lateral section along line X-X of a detail in FIG. 9.

As shown in FIGS. 9 and 10, an inner surface of connecting tab 16 of sealing flap 5 is glued by permanent glue 17*a* to flap 18 of lid 7, so that connecting tab 16 of sealing flap 5 folds 180° onto the rest of sealing flap 5, and sealing flap 5 forms a U-shaped bend when opening lid 7.

As shown in FIGS. 8 and 10, sealing flap 5 is glued to the outer surface of inner package 3 by re-stick glue 17*b* (i.e. non-dry glue allowing the sealing flap to be detached and re-attached repeatedly). It is important to note that connecting tab 16 of sealing flap 5 only has permanent glue 17*a*, and no re-stick glue 17*b* at all.

By making connecting tab 16. of sealing flap 5 permanently integral with lid 7, sealing flap 5 can be raised simultaneously with lid 7. When opening lid 7, sealing flap 5 is eased gradually off inner package 3 without stressing the cigarettes inside inner package 3; and, likewise, when closing lid 7, sealing flap 5 is eased gradually back onto inner package 3 to accurately wrap round the contour of inner package 3.

In accordance with the present invention, connecting tab 16 is separated from the rest of sealing flap 5 by a fold line 19, the purpose of which is to make sealing flap 5 easier to fold at connecting tab 16, by reducing the force required to fold sealing flap 5 at connecting tab 16 (and therefore also the tendency of sealing flap 5 to spring back to its original position when folded at connecting tab 16). By virtue of fold line 19, when opening and closing lid 7 and sealing flap 5 integral with lid 7, sealing flap 5 folds more easily (i.e. with less 'force') at connecting tab 16, and therefore with less pull between connecting tab 16 and the inner surface of lid 7 (i.e. less pull on permanent glue 17*a*), thus reducing stress on the permanent glue 17*a* connecting connecting tab 16 of sealing flap 5 to the inner surface of lid 7, and so greatly reducing (or even eliminating altogether) the risk of permanent glue 17*a* failing, and sealing flap 5 coming unglued from lid 7.

Figure 12:
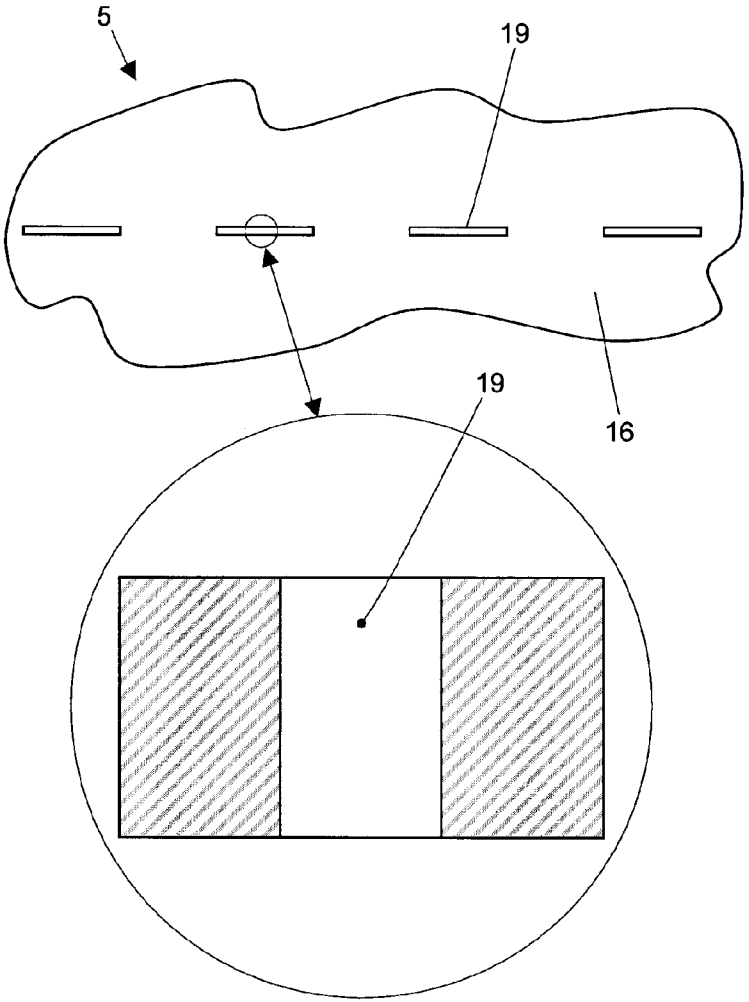
FIGS. 11 and 12 show, schematically, two embodiments of a fold line of an inner package sealing flap of the FIG. 1 packet of cigarettes.
Figure 11:
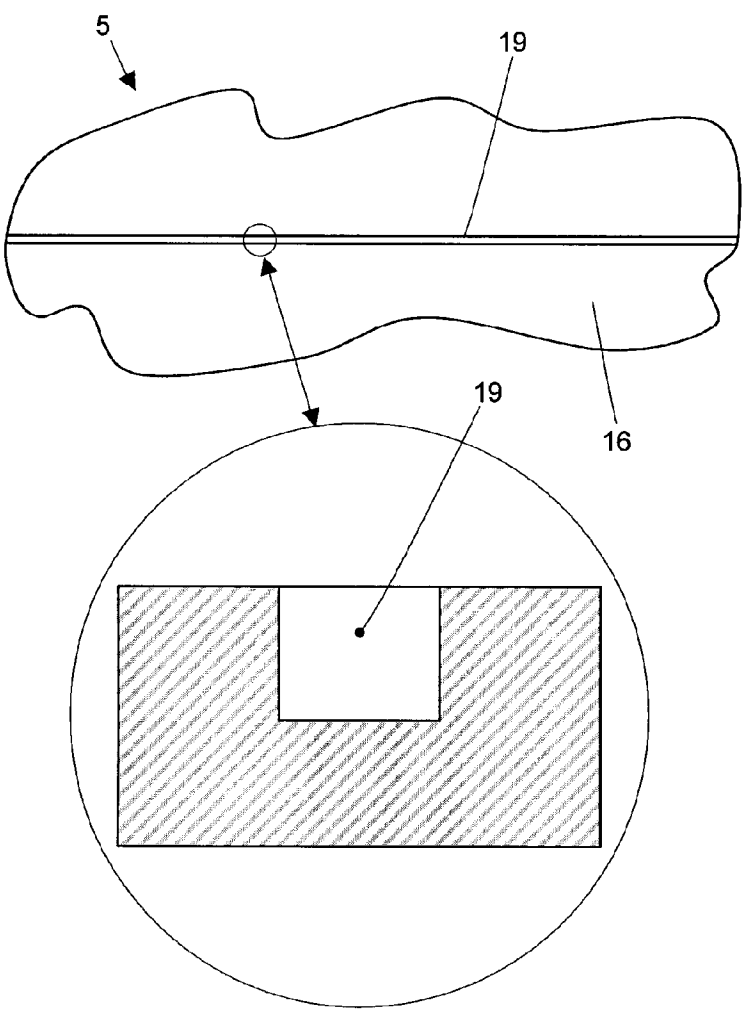

Fold line 19 is preferably formed by cutting or removing material from sealing flap 5, i.e. forming a 'furrow' in the material of sealing flap 5. In the FIG. 11 embodiment, fold line 19 is continuous (i.e. extends seamlessly along the whole extension of connecting tab 16) and is formed by scoring (i.e. making a non-through incision in) the material of sealing flap 5. In the FIG. 12 embodiment, fold line 19 is discontinuous (i.e. composed of separate parts) and is formed by cutting through the material of sealing flap 5. In a further embodiment not shown, fold line 19 is discontinuous (i.e. composed of separate parts) and is formed by scoring the material of sealing flap 5. When sealing flap 5 is made of multilayer material (i.e. comprising at least two superimposed layers joined together) and fold line 19 is formed by scoring, one or even more layers of the material may be cut through, leaving the other layer/s intact.

Fold line 19 may be formed, for example, using cutters for mechanically cutting the material of sealing flap 5, or a laser beam for removing part of the material of sealing flap 5.

As shown in FIGS. 8 and 10, connecting tab 16 of sealing flap 5, only having permanent glue 17*a* and no re-stick glue 17*b* at all, adheres permanently (i.e. non-removably) to flap 18 of lid 7 by means of permanent glue 17*a*, and does not adhere at all to the outer surface of inner package 3.

In a preferred embodiment shown in FIGS. 8-10, permanent glue 17*a* touches, i.e. borders directly on, fold line 19 with no gap in between (i.e. no space/clearance between fold line 19 and permanent glue 17*a*). This is an important feature, which provides for reducing stress on permanent glue 17*a* when opening lid 7 (opening lid 7 is the most critical stage, during which sealing flap 5 has to be detached partly from inner package 3 by partly 'peeling' off re-stick glue 17*b*, so greater force has to be transmitted from lid 7 to sealing flap 5 via connecting tab 16 and therefore via permanent glue 17*a*). When permanent glue 17*a* touches fold line 19 (i.e. with no space in between), the pull exerted on permanent glue 17*a* is directed perpendicular to it, and so only has a perpendicular component (which permanent glue 17*a* withstands best) and no tangential component (which permanent glue 17*a* withstands least).

In a preferred embodiment shown in FIGS. 8 and 10, fold line 19 is separated by a distance D of other than zero from re-stick glue 17*b*, i.e. fold line 19 and re-stick glue 17*b* are separated by a 'clear' space (i.e. with no re-stick glue 17*b*) of a width D other than zero and normally of at least 1 mm. The function of the clear space, with no re-stick glue 17*b*, next to fold line 19 is to reduce stress on permanent glue 17*a* when opening lid 7. That is, by virtue of the clear space with no re-stick glue 17*b*, the initial opening movement of lid 7 (roughly the first 4-10 degrees rotation of lid 7 about hinge 8) involves no detachment of sealing flap 5 from inner package 3 and therefore no serious pull on permanent glue 17*a*, which means sealing flap 5 can begin folding into an 'S' about fold line 19 and assume a position locally perpendicular to flap 18 of lid 7 before any serious pull is exerted on permanent glue 17*a*. In other words, by virtue of the clear space with no re-stick glue 17*b*, sealing flap 5 transmits serious pull to permanent glue 17*a* (to detach sealing flap 5 partly from inner package 3 by partly 'peeling' off re-stick glue 17*b*) when the pulling force is directly entirely perpendicular (i.e. with no tangential component) to permanent glue 17*a*, which, as stated, withstands perpendicular pull better than tangential pull.

Figure 13:
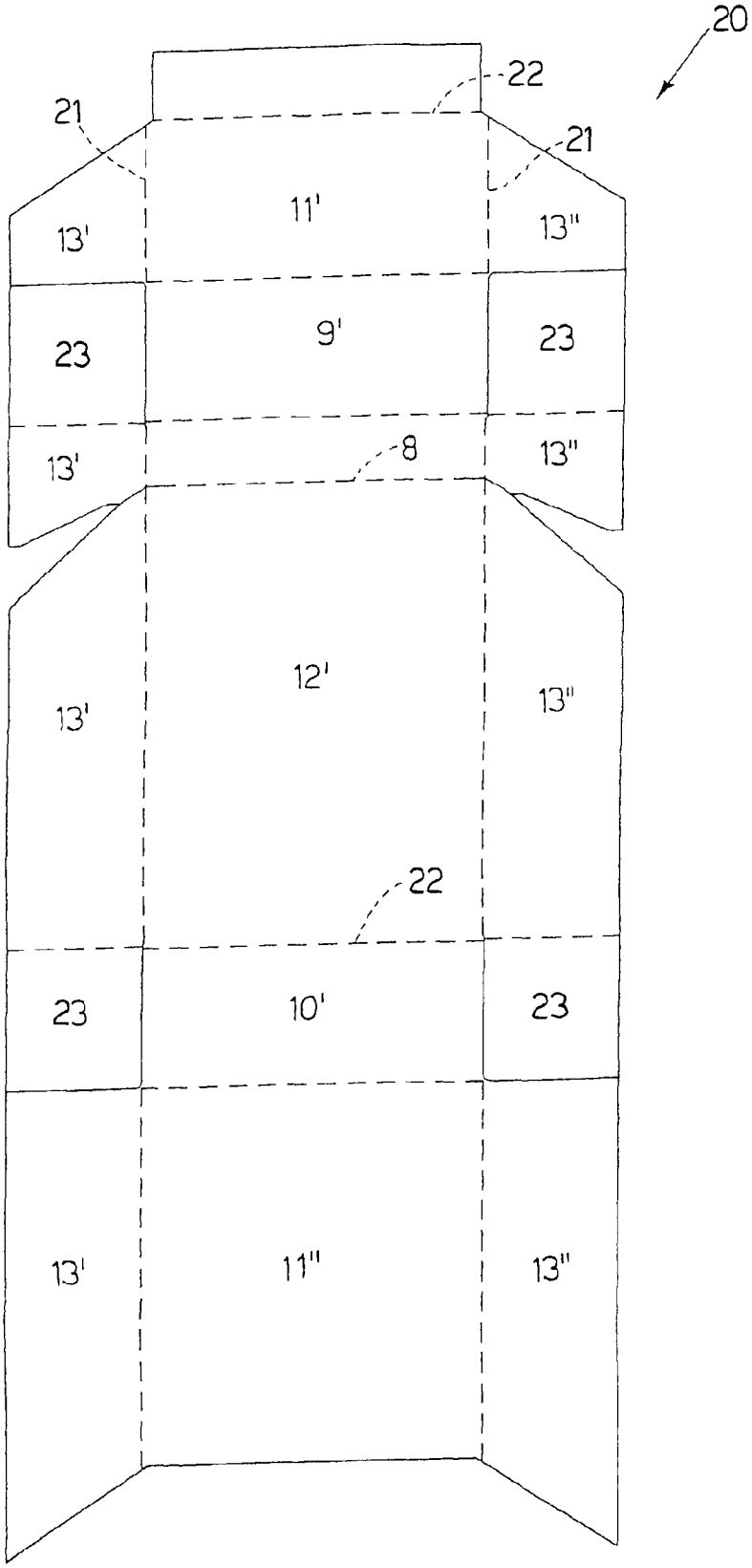
FIG. 13 shows a spread-out view of a blank from which to form an outer container of the FIG. 1 packet of cigarettes.

As shown in FIG. 13, outer container 2 is formed by folding a flat, substantially elongated rectangular blank 20 made of cardboard, and the parts of which are indicated below using the same reference numbers, with superscripts, as for the corresponding parts of outer container.

Blank 20 has two longitudinal fold lines 21, and a number of transverse fold lines 22 defining, between longitudinal fold lines 21, a panel 11' forming a top portion of front wall 11 (i.e. the portion forming part of lid 7); a panel 9' forming top wall 9; a panel 12' forming rear wall 12; a panel 10' forming bottom wall 10; and a panel 11" forming a bottom portion of front wall 11 (i.e. the portion forming part of outer container 2).

Panels 11', 11" and 12' each have two lateral wings 13', 13" located on opposite sides of respective panel 11', 11", 12' and separated from respect panel 11', 11", 12' by longitudinal fold lines 21. Panel 11' has flap 18; and panel 12' has two rectangular tabs 23 at opposite ends of each lateral wing 13', 13".

To form packet 1, lateral wings 13' and 13" are superimposed and glued together to form minor lateral walls 13 of outer container 2; and each tab 23 is folded squarely with respect to relative lateral wing 13', 13", and is superimposed on and glued to an inner surface of a relative panel 9', 10' to define an inner portion of a relative wall 9, 10.

Figure 14:
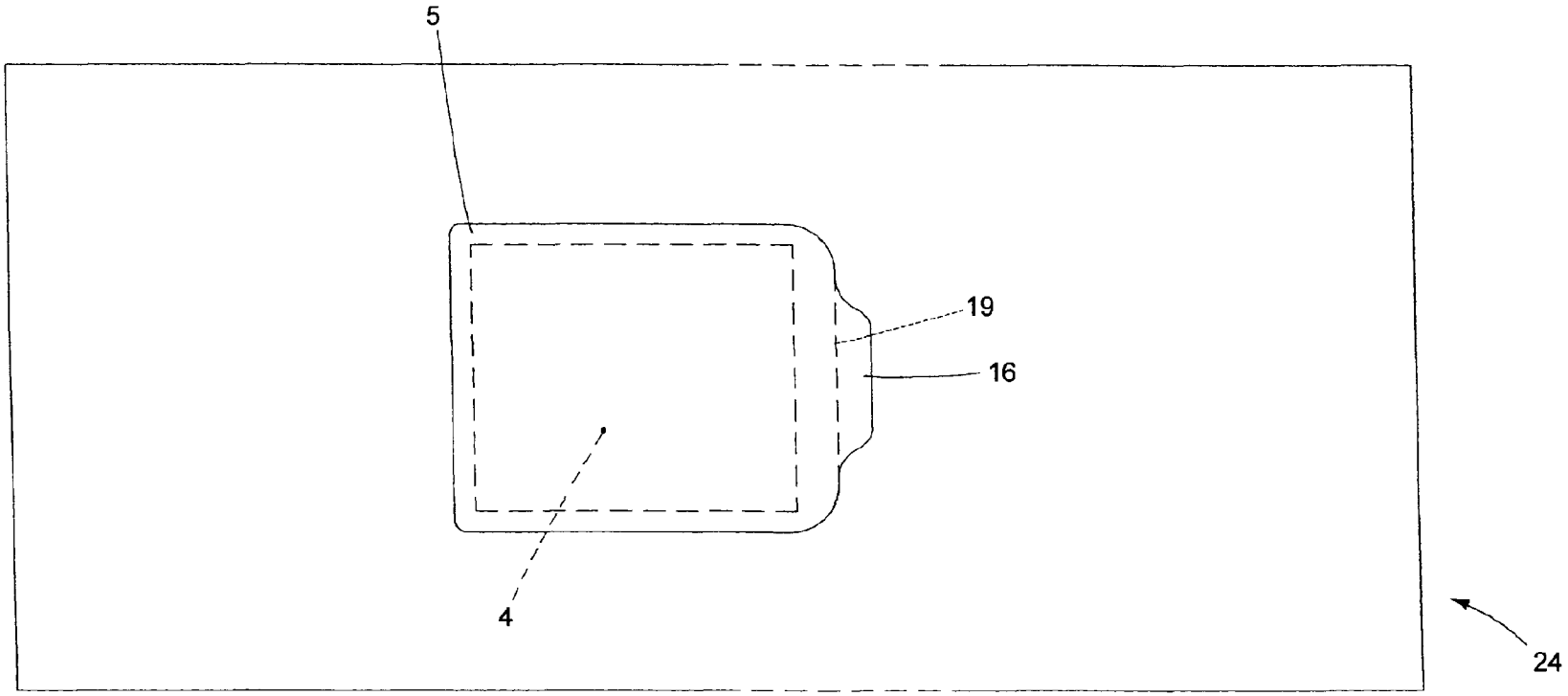
FIG. 14 shows a spread-out view of a sheet of airtight packing material from which to form an inner package of the FIG. 1 packet of cigarettes.

As shown in FIG. 14, inner package 3 is formed by folding a rectangular sheet 24 of packing material. Sheet 24 is first cut to define extraction opening 4, and is then fitted with sealing flap 5 gummed on the underside with re-stick glue 17*b*, which, inside extraction opening 4, glues the inner portion of sheet permanently to sealing flap 5, and, outside extraction opening 4, glues sheet 24 removably to sealing flap 5.

Packet 1 of cigarettes described has numerous advantages.

In particular, the risk of sealing flap 5 detaching from lid 7 due to failure of permanent glue 17*a* is substantially eliminated by fold line 19.

Fold line 19 in no way alters the look of packet 1 of cigarettes, by being totally concealed from view.

Fold line 19 is cheap and easy to produce. It can be formed quite easily before applying sealing flap 5 to sheet 24 of packing material, and in no way affects folding of sheet 24 or blank 20.

Given its numerous advantages, the design of packet 1 of cigarettes described may also be applied to the manufacture of a carton of cigarettes, which is substantially the same as packet 1 described, except that it contains a group of packets of cigarettes, as opposed to a group of cigarettes.

The invention claimed is:

1. A package of tobacco articles comprising:

a group of tobacco articles;

a cup-shaped outer container (2) having an open top end (6), and a cup-shaped lid (7) hinged to the outer container (2) along a hinge (8) to rotate, with respect to the outer container (2), between an open position and a closed position opening and closing the open top end (6) respectively; and an inner package (3), which is housed in the outer container (2), encloses the group of tobacco articles, and has a tobacco article extraction opening (4) closed by a sealing flap (5);

wherein the sealing flap (5) comprises a connecting tab (16) glued permanently and non-removably to the lid (7) by permanent glue (17*a*), so that opening and closing the lid (7) also simultaneously opens and closes the sealing flap (5); and wherein the connecting tab (16) is separated from the rest of the sealing flap (5) by a fold line (19);

wherein the sealing flap (5) is fixed to the inner package (3) by non-dry, re-stick glue (17*b*) about the extraction opening (4), to allow the sealing flap (5) to be repeatedly detached partly from and re-fixed to the inner package (3);

wherein the connecting tab (16) has permanent glue (17*a*) but no re-stick glue (17*b*); and wherein the fold line (19) dividing the connecting tab (16) from the sealing flap (5) is separated from the re-stick glue (17*b*) on the sealing flap (5) by a distance (D) of other than zero so that there is a gap between the re-stick glue (17*b*) on the sealing flap (5) and the connecting tab (16).

2. A package as claimed in claim 1, wherein the fold line (19) is continuous and formed by scoring the material of the sealing flap (5).

3. A package as claimed in claim 1, wherein the fold line (19) is discontinuous and formed by cutting through the material of the sealing flap (5).

4. A package as claimed in claim 1, wherein the fold line (19) is discontinuous and formed by scoring the material of the sealing flap (5).

5. A package as claimed in claim 1, wherein the connecting tab (16) of the sealing flap (5) is glued to a flap (18) of the lid (7).

6. A package as claimed in claim 1, wherein an outer surface of the connecting tab (16) of the sealing flap (5) is glued by spots of permanent glue (17*a*) to the inner surface of the lid (7).

7. A package as claimed in claim 1, wherein the connecting tab (16) of the sealing flap (5) is folded 180° onto the rest of the sealing flap (5), and an inner surface of the connecting tab (16) of the sealing flap (5) is glued by spots of permanent glue (17*a*) to the inner surface of the lid (7).

8. A package as claimed in claim 1, wherein the permanent glue (17*a*) on the connecting tab (16) touches the fold line (19), i.e. borders directly on the fold line (19) with no gap in between.

9. A package as claimed in claim 1, wherein the distance (D) between the fold line (19) and the re-stick glue (17*b*) on the sealing flap (5) is at least 1 mm.

10. A package of tobacco articles comprising:

a group of tobacco articles;

a cup-shaped outer container (2) having an open top end (6), and a cup-shaped lid (7) hinged to the outer container (2) along a hinge (8) to rotate, with respect to the outer container (2), between an open position and a closed position opening and closing the open top end (6) respectively; and an inner package (3), which is housed in the outer container (2), encloses the group of tobacco articles, and has a tobacco article extraction opening (4) closed by a sealing flap (5);

wherein the sealing flap (5) comprises a connecting tab (16) glued permanently and non-removably to the lid (7) by permanent glue (17*a*), so that opening and closing the lid (7) also simultaneously opens and closes the sealing fla (5);

wherein the sealing flap (5) is fixed to the inner package (3) by non-dry, re-stick glue (17*b*) about the extraction opening (4), to allow the sealing flap (5) to be repeatedly detached partly from and re-fixed to the inner package (3);

wherein the connecting tab (16) has permanent glue (17*a*) but no re-stick glue (17*b*); and wherein there is a clear space with no re-stick glue (17*b*) between the connecting tab (16) and the sealing flap (5) so that there is a gap between the re-stick glue (17*b*) on the sealing flap (5) and the connecting tab (16).

11. A package as claimed in claim 10, wherein there is a gap between the permanent glue (17*a*) on the connecting tab (16) and the re-stick glue (17*b*) on the sealing flap (5).

12. A package as claimed in claim 10, wherein the permanent glue (17*a*) on the connecting tab (16) borders directly the sealing flap (5) with no gap in between.

13. A package as claimed in claim 10, wherein the distance (D) between the re-stick glue (17*b*) on the sealing flap (5) and the connecting tab (16) is at least 1 mm.

14. A package of tobacco articles comprising:

a group of tobacco articles;

a cup-shaped outer container (2) having an open top end (6), and a cup-shaped lid (7) hinged to the outer container (2) along a hinge (8) to rotate, with respect to the outer container (2), between an open position and a closed position opening and closing the open top end (6) respectively; and an inner package (3), which is housed in the outer container (2), encloses the group of tobacco articles, and has a tobacco article extraction opening (4) closed by a sealing flap (5);

wherein the sealing flap (5) comprises a connecting tab (16) glued permanently and non-removably to the lid (7) by permanent glue (17*a*), so that opening and closing the lid (7) also simultaneously opens and closes the sealing flap (5);

wherein the sealing flap (5) is fixed to the inner package (3) by non-dry, re-stick glue (17*b*) about the extraction opening (4), to allow the sealing flap (5) to be repeatedly detached partly from and re-fixed to the inner package (3);

wherein the connecting tab (16) has permanent glue (17*a*) but no re-stick glue (17*b*); and wherein there is a gap between the re-stick glue (17*b*) on the sealing flap (5) and the connecting tab (16).

15. A package as claimed in claim 14, wherein there is a gap between the permanent glue (17*a*) on the connecting tab (16) and the re-stick glue (17*b*) on the sealing flap (5).

16. A package as claimed in claim 14, wherein the permanent glue (17*a*) on the connecting tab (16) borders directly the sealing flap (5) with no gap in between.

17. A package as claimed in claim 14, wherein the distance (D) between the re-stick glue (17*b*) on the sealing flap (5) and the connecting tab (16) is at least 1 mm.

18. A package of tobacco articles comprising:

a group of tobacco articles;

a cup-shaped outer container (2) having an open top end (6), and a cup-shaped lid (7) hinged to the outer container (2) along a hinge (8) to rotate, with respect to the outer container (2), between an open position and a closed position opening and closing the open top end (6) respectively; and an inner package (3), which is housed in the outer container (2), encloses the group of tobacco articles, and has a tobacco article extraction opening (4) closed by a sealing flap (5);

wherein the sealing flap (5) comprising a connecting tab (16) glued permanently and non-removably to the lid (7) by permanent glue (17*a*), so that opening and closing the lid (7) also simultaneously opens and closes the sealing flap (5);

wherein the sealing flap (5) is fixed to the inner package (3) by non-dry, re-stick glue (17*b*) about the extraction opening (4), to allow the sealing flap (5) to be repeatedly detached partly from and re-fixed to the inner package (3);

wherein the connecting tab (16) has permanent glue (17*a*) but no re-stick glue (17*b*); and wherein the sealing flap (5) has an area, which is free of glue on both sides and is arranged between the permanent glue (17*a*) connecting the bottom tab (16) of the sealing flap (5) to the lid (7) and the re-stick glue (17*b*) connecting the sealing flap (5) to the inner package (3).

19. A package as claimed in claim 18, wherein there is a gap between the permanent glue (17*a*) on the connecting tab (16) and the re-stick glue (17*b*) on the sealing flap (5).

20. A package as claimed in claim 18, wherein the permanent glue (17*a*) on the connecting tab (16) borders directly the sealing flap (5) with no gap in between.

21. A package as claimed in claim 18, wherein the distance (D) between the re-stick glue (17*b*) on the sealing flap (5) and the connecting tab (16) is at least 1 mm.

* * * * *